United States Patent [19]

Edwards

[11] 3,956,904

[45] May 18, 1976

[54] COMPRESSOR-EXPANDER FOR REFRIGERATION HAVING DUAL ROTOR ASSEMBLY

[75] Inventor: Thomas C. Edwards, Oviedo, Fla.

[73] Assignee: The Rovac Corporation, Maitland, Fla.

[22] Filed: Feb. 3, 1975

[21] Appl. No.: 546,391

[52] U.S. Cl. ..... 62/402; 418/225

[51] Int. Cl.[2] ..... F25D 9/00; F04B 17/00

[58] Field of Search ..... 62/402; 418/225; 417/406

[56] References Cited

UNITED STATES PATENTS

| | | | |
|---|---|---|---|
| 2,562,698 | 7/1951 | Clerc | 418/225 |
| 3,160,147 | 12/1964 | Hanson | 418/225 |
| 3,464,395 | 9/1969 | Kelly | 418/225 |
| 3,686,893 | 8/1972 | Edwards | 62/402 |

*Primary Examiner*—Lloyd L. King

*Attorney, Agent, or Firm*—Wolfe, Hubbard, Leydig, Voit & Osann, Ltd.

[57] ABSTRACT

A compressor-expander assembly for use in a refrigeration system which includes a housing defining compression and expansion chambers of generally cylindrical section arranged side by side. Compressor and expander rotors of cylindrical shape are journaled for rotation in the respective chambers. The rotor shaft is offset from the chamber axis so that the surface of each rotor extends closely adjacent to the wall of the chamber causing each chamber to have a convergent side and a divergent side. Equally spaced about the rotor periphery are a set of vanes having their outer edges extending into engagement with the walls of the respective chambers so as to define a series of compartments of changing volume. The compression chamber has an arcuate inlet port which extends over substantially the entire divergent side and a concentrated outlet port which is located near the end of the convergent side. The expansion chamber has a concentrated inlet port which is located near the beginning of the divergent side and an outlet port which extends over substantially the entire convergent side. A heat exchanger is connected between the compressor outlet port and the expander inlet port. In operation, ambient air drawn into the compressor inlet port is compressed in the convergent side accompanied by an increase in temperature, cooled by passage through the heat exchanger, introduced into the expansion chamber, and then expanded in the divergent side to ambient pressure accompanied by a sharp drop in temperature. The compressor outlet port and expander inlet port are relatively so positioned that a smaller volume of air is defined, at cut-off, between adjacent vanes at the expander inlet port than at the compressor outlet port, with the result that compressed air is conducted through the heat exchanger at substantially constant pressure.

24 Claims, 23 Drawing Figures

Fig. 1.
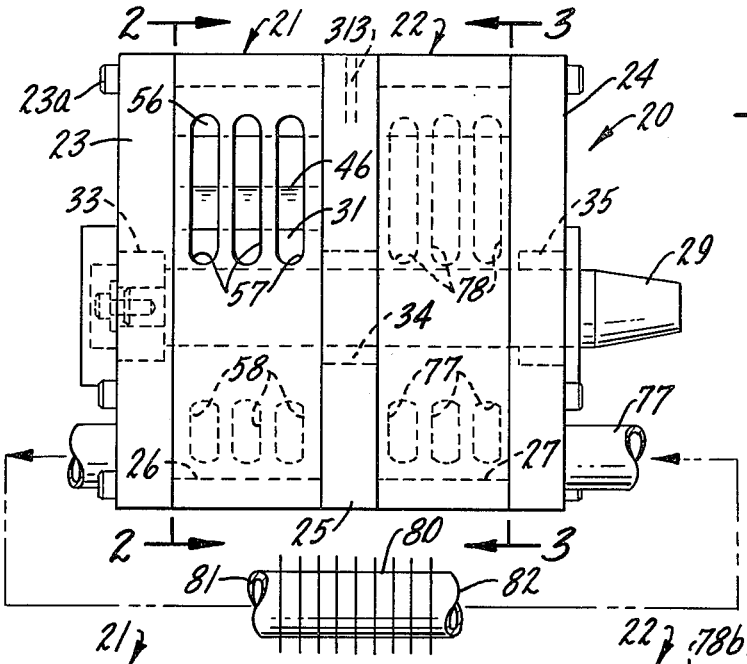
Fig. 2a.
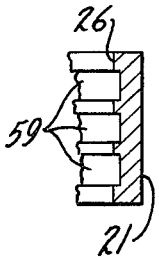
Fig. 2.
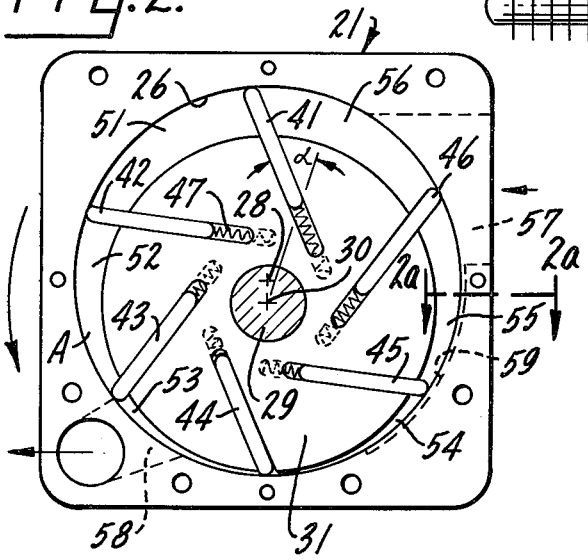
Fig. 3.
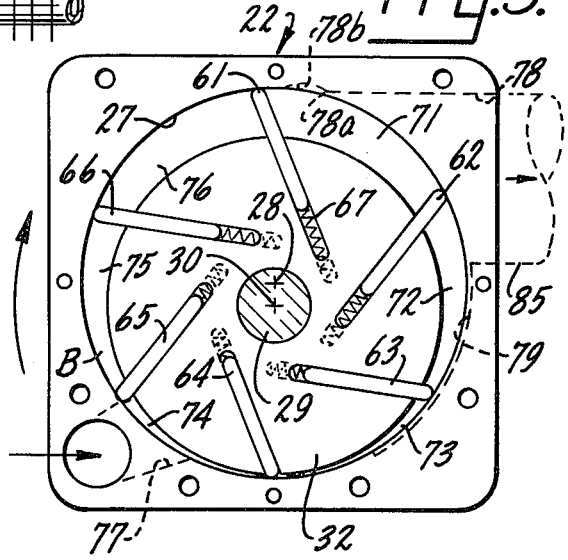
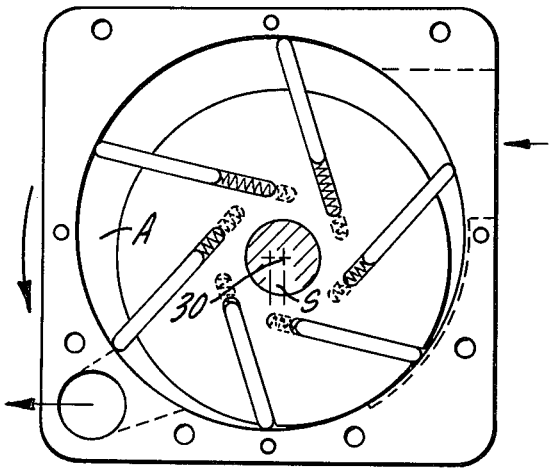
Fig. 4.
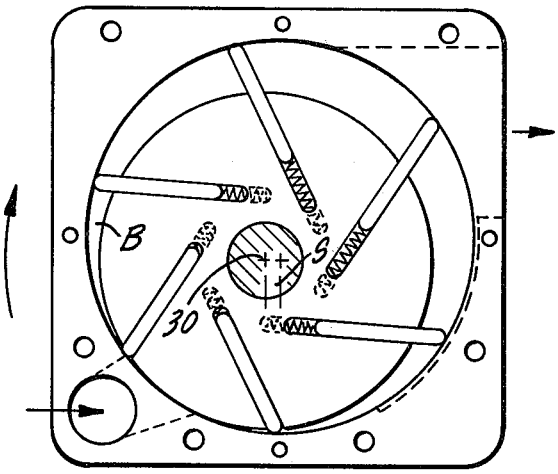
Fig. 5.

fig.11.
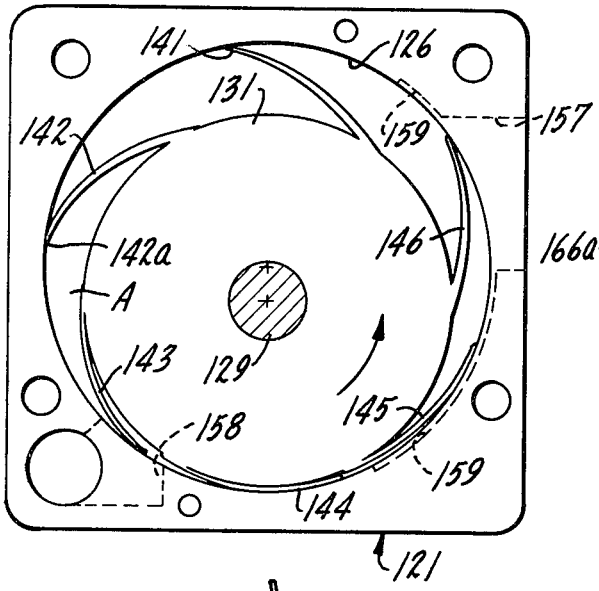
fig.12.
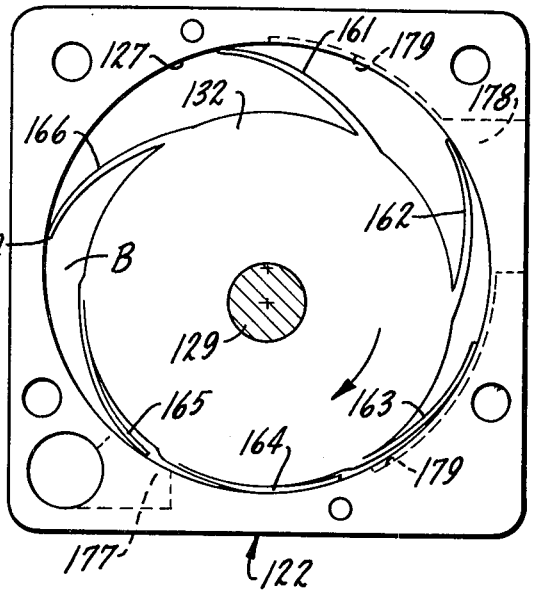
fig.13.
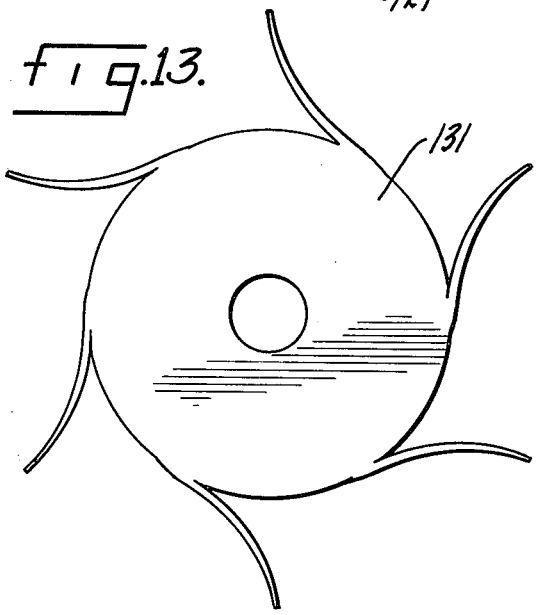
fig.14.
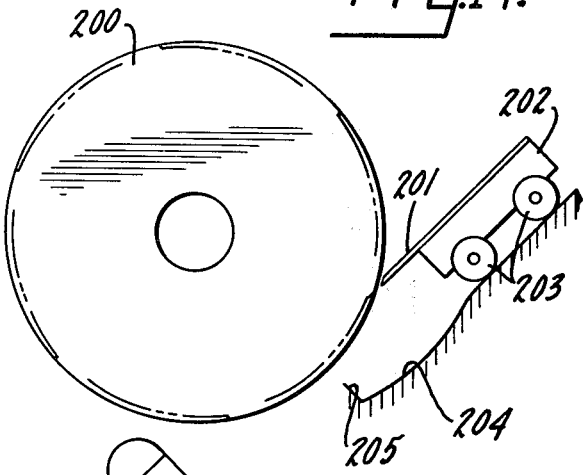
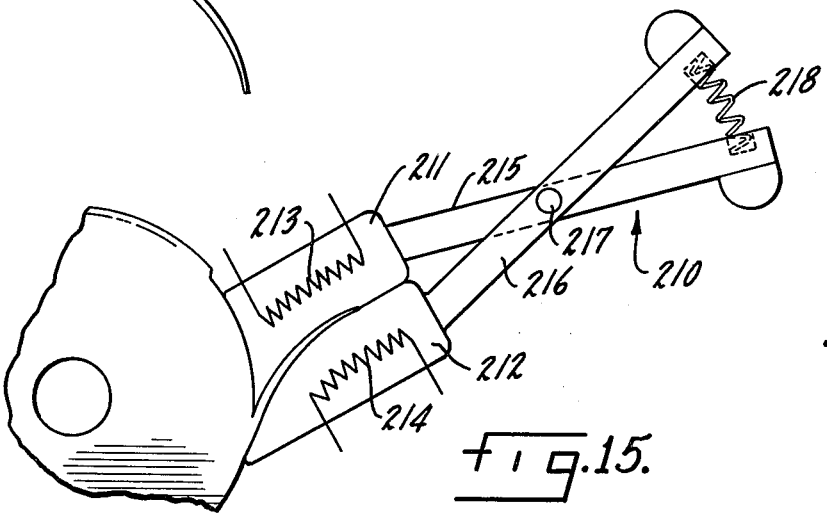
fig.15.
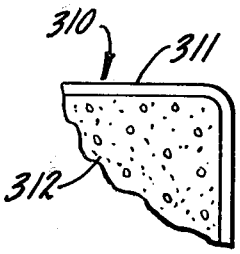
fig.20.

fig.16.
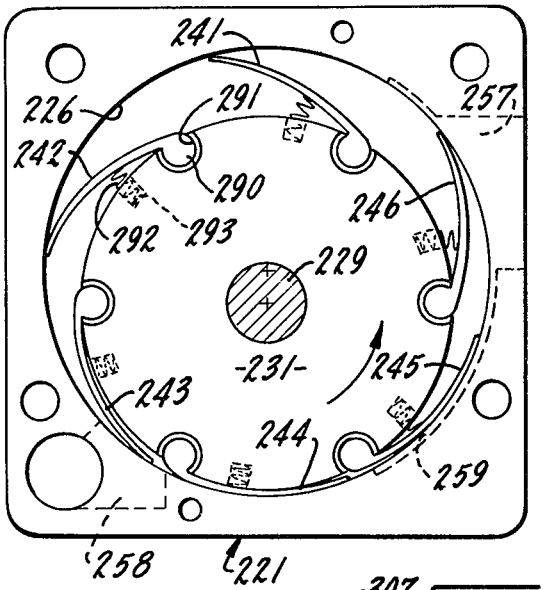
fig.17.
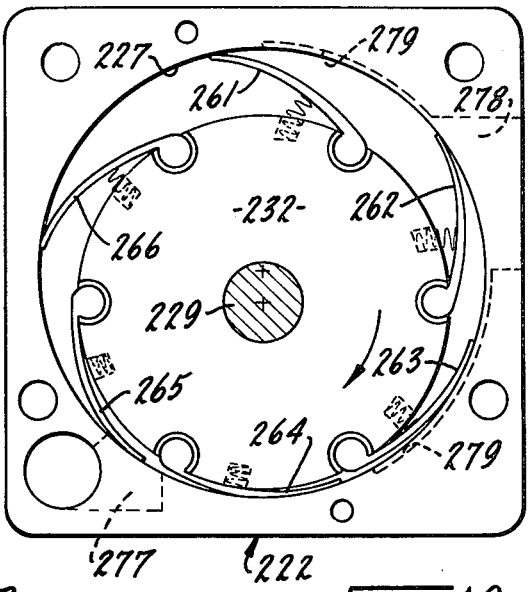
fig.18.
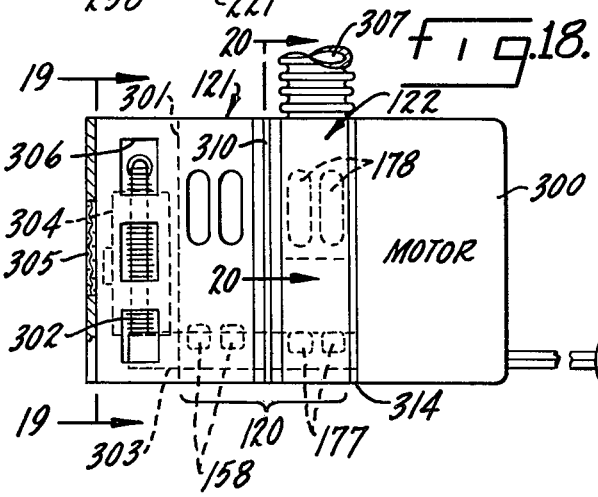
fig.19.
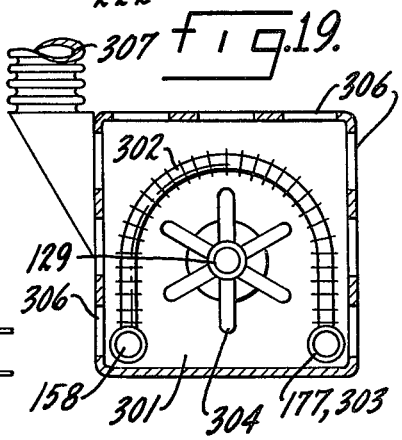
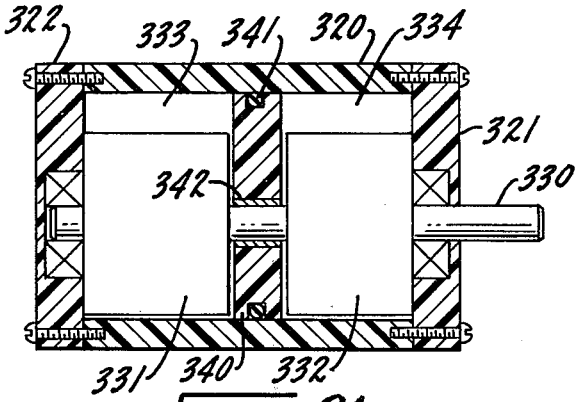
fig.21.
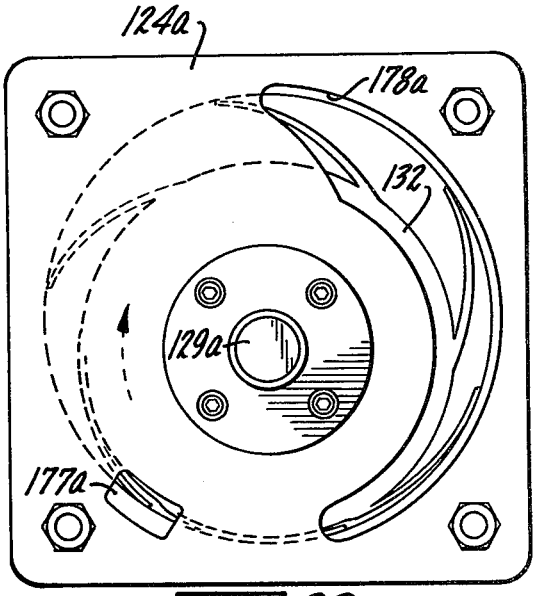
fig.22.

COMPRESSOR-EXPANDER FOR REFRIGERATION HAVING DUAL ROTOR ASSEMBLY

In a preferred embodiment, the heat exchanger ports are symmetrically located and substantially equal masses of air are defined at cut-off between adjacent vanes by employing an expansion chamber having a shorter axial length than the compression chamber.

In another embodiment, the rotor axis is incrementally shifted with respect to the housing in a lateral direction to achieve the equal mass condition.

In a further embodiment a refrigeration system especially suitable for extreme miniaturization, the rotors are formed using arcuate vanes formed of flexible plastic which are anchored to the rotor and which are prestressed outwardly to provide a slight outward bias against the walls of the respective chambers, the vanes in both chambers being oriented to cuppingly resist the applied pressure. While the vanes may be pivoted to the rotor, it is preferred to form the vanes integrally with the rotor, using a durable fatigue resistant plastic having self-lubricating properties, for example, by a "skiving" operation. In one of the aspects of the present invention, the housing is formed in two portions having a separator plate in between them, and with end plates for mounting bearings journaling the shaft, the separator plate providing insulation to inhibit direct flow of heat from one portion of the device to the other so that the two portions operate efficiently at different operating temperatures.

In a further aspect of the invention, a complete single unit refrigeration system is formed by compact integration of a compressor-expander of the above type with a motor at one end and a heat exchanger and fan at the other.

In my prior U.S. Pat. No. 3,686,893 which issued Aug. 29, 1972, there is described a compressor-expander which employs a cylindrical vaned rotor in a chamber of elliptical section thereby providing a unitary compressor and expander each having inlet and outlet ports and with a heat exchanger interposed between them. While such construction has been found to operate satisfactorily, highly precise manufacturing techniques must be used, taking into account the relatively large vane accelerational forces and the necessity for machining a chamber of elliptical form. Use of an elliptical chamber makes it difficult to take advantage of the economies inherent in the use of hinged, or pivoted vanes as contrasted with reciprocating vanes subject to sliding friction.

It is, accordingly, an object of the present invention to provide a compressor-expander having separate compression and expansion chambers arranged side by side, and with separate compressor and expander rotors rotated by a common driving means, with the air being compressed in the compression chamber, routed through a heat exchanger, and then expanded in the expansion chamber for discharge in the cold state.

It is more specifically an object of the present invention to provide a dual, as contrasted with unitary, compressor-expander having separate chambers and separate rotors for the two processes but with the elements compactly integrated into a unitary housing and sharing a common drive shaft.

It is yet another object of the present invention to provide a compressor-expander having improved means for insuring that compressed air is conducted through the heat exchanger at substantially constant pressure, in other words, improved means for insuring that equal masses of air are defined, at cut-off, between adjacent vanes at the expander inlet port and at the compressor outlet port.

It is a more specific object of the present invention to provide a design of compressor-expander which enables the usual sliding vanes to be eliminated and which makes it possible to employ vanes which are hinged to the surface of the rotor, or which are flexible and anchored cantilever-fashion to the surface of the rotor, thereby to avoid the frictional losses which are inherent in the use of radial sliding vanes.

It is yet another object of the present invention to provide a rotor having flexible vanes which are not only integral with the rotor but which are formed in situ from the rotor surface, thereby to produce a vane of tapering section which is highly flexible and which may be made self-lubricating to minimize frictional loss. In this connection, it is an object of the invention to provide a novel rotor construction employing thin, flexible vanes normally incapable of handling air at high pressure but which are oriented, in both the compression and expansion portions, in respectively opposite directions, with all of the vanes cupped toward the direction of the pressure, thereby to avoid "blow by" of air around the edges of the vanes.

It is, generally stated, an object of the present invention to provide a dual compressor-expander which achieves a high degree of efficiency and economy. Thus, it is an object to provide a compressor-expander assembly which avoids the coriolis accelerational effects which are encountered in compressor-expanders of the unitary type and which therefore conserves the energy lost in blade acceleration while utilizing chambers of cylindrical shape which are easily and cheaply machined using ordinary boring and grinding machine tools.

It is yet another object of the present invention to provide a compressor-expander in which the two portions, while mechanically unitary, are nevertheless thermally separated from one another, thereby to minimize loss of heat from one side of the device to the other and to enable the compressing and expanding functions to be performed, on a continuous basis, at different temperatures. This is to be contrasted with the unitary device disclosed and claimed in the above patent in which there is an unavoidable flow of heat, in short circuiting fashion, from the compression to the expansion side via the common rotor and shared housing. Consequently, it is an object of the present invention to provide a compressor-expander which, in spite of the fact that it has two rotors for the respective functions, is nevertheless highly efficient and susceptible to such simplified construction as to enable the device to be made in highly miniaturized form for use wherever "spot" cooling is required.

Other objects and advantages of the invention will become apparent upon reading the attached detailed description and upon reference to the drawings in which:

FIG. 1 is an elevational view of a compressor-expander assembly constructed in accordance with the present invention;

FIG. 2 is a transverse section looking along the line 2—2 in FIG. 1;

Figure 6:
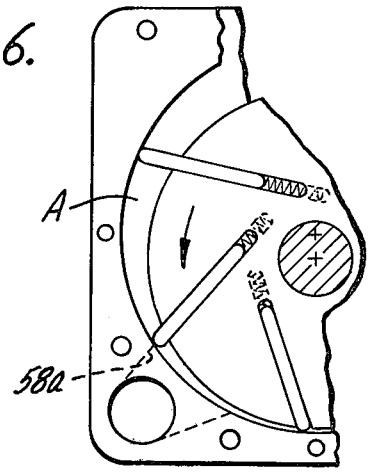
Figure 7:
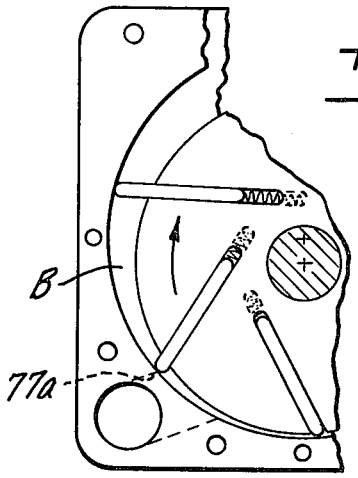
Figure 8:
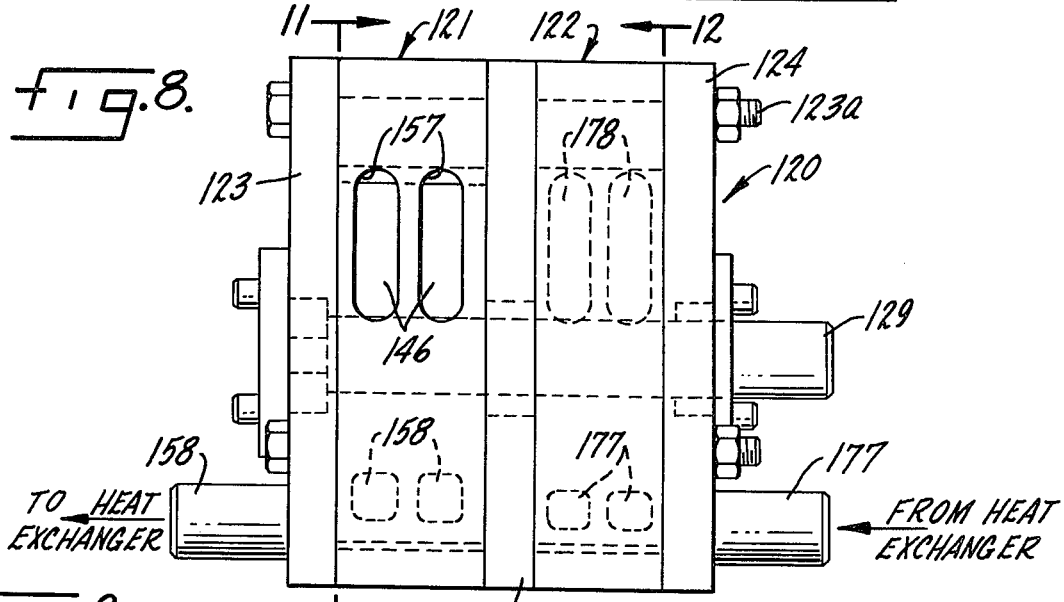
Figure 9:
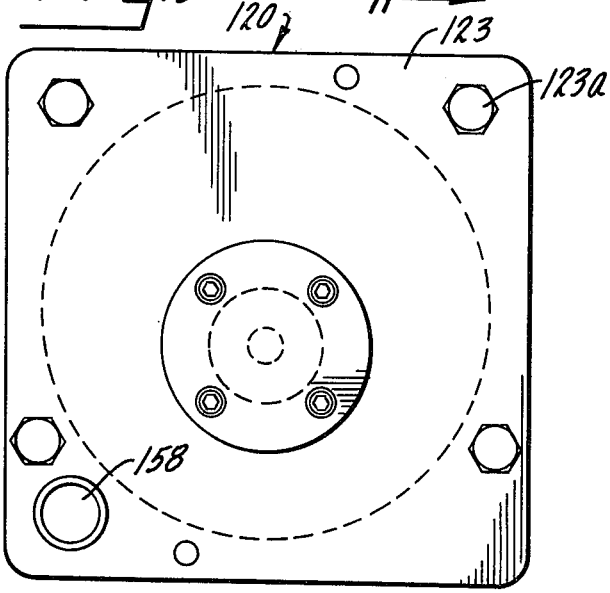
Figure 10:
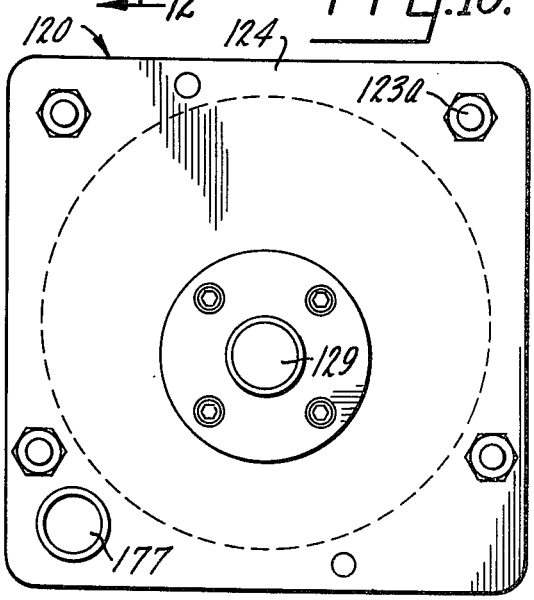

FIG. 2*a* is a fragmentary section taken along the line 2*a*—2*a* in FIG. 2;

FIG. 3 is a transverse section looking along the line 3—3 in FIG. 1;

FIGS. 4 and 5 are views corresponding to FIGS. 2 and 3 using similar numerals, but showing the rotor axis incrementally shifted in the lateral direction, the incremental shift being exaggerated for clarity;

FIGS. 6 and 7 are similar, but fragmentary, views showing achievement of the same effect by shifting the cut-off edges of the heat exchanger ports in opposite directions;

FIG. 8 is an elevational view of a highly miniaturized and simplified version of the device shown greater than full scale;

FIGS. 9 and 10 are respective end views;

FIG. 11 is a transverse section looking along the line 11—11 in FIG. 8;

FIG. 12 is a transverse section looking along the line 12—12 in FIG. 8;

FIG. 13 shows a rotor of the type employed in FIGS. 8–12 in which flexible vanes are integral with the rotor body and prestressed outwardly;

FIG. 14 shows a rotor prior to formation of the vanes by a skiving operation;

FIG. 15 shows setting of the skived vanes by heat;

FIGS. 16 and 17 are views corresponding to FIGS. 11 and 12 but showing use of hinged vanes, looking along correspondingly numbered lines in FIG. 8;

FIG. 18 shows an integrated refrigeration unit constructed in accordance with the present invention;

FIG. 19 is an end view, with end plate removed, looking along line 19—19 in FIG. 18 and showing the heat exchanger;

FIG. 20 is a fragmentary section taken along line 20—20 in FIG. 18;

FIG. 21 shows, in longitudinal section, a further simplified version of the inventive construction; and FIG. 22 shows porting through an end wall.

While the invention has been described in connection with certain preferred embodiments, it will be understood that I do not intend to be limited by the particular embodiments shown, but intend, on the contrary, to cover the various alternative and equivalent forms of the invention included within the spirit and scope of the appended claims.

Turning now to the drawings and particularly to FIGS. 1–3, there is shown a compressor-expander 20 having a compressor 21 and an expander 22. The compressor has an end or bearing plate 23, while the expander is enclosed by a bearing plate 24. Interposed between the two sections is a separator plate 25. The elements 21–25, inclusive, are tightly clamped together by draw bolts 26 or the like to form a durable and compact stack, with the elements together comprising the housing of the device. The compressor section 21 defines a chamber having a cylindrical wall 26, while the expander portion defines a separate chamber having a cylindrical wall 27. The two chambers are coaxial with one another on a common axis 28.

In carrying out the present invention, a shaft 30 extends through the device carrying a compressor rotor 31 and an expander rotor 32 in the respective chambers, the shaft being mounted in sealed anti-friction bearings 33, 34, 35.

The rotor 31 is provided with equally spaced vanes 41–46 slidably received in respective slots and having springs 47 for urging the vanes outwardly so that the outer edges are in functional engagement with the cylindrical wall 26. If desired, each vane may be equipped with rollers (not shown) one at each axial end, and which ride in circular cam tracks (also not shown) formed in the plates 23, 24, the cam tracks being centered with respect to the chamber axis 28. Use of rollers and cam tracks permits establishment of a small amount of running clearance at the outer edge of each of the vanes, a clearance which is sufficient to avoid direct rubbing but which is nevertheless sufficiently small as to incur negligible leakage, cross reference being made to my copending application Ser. No. 400,965, filed Sept. 26, 1973.

The axis of the rotor shaft is intentionally eccentric with respect to the wall 26 of the chamber, that is, the rotor axis, indicated at 30, is offset downwardly from the chamber axis 28 so that the vanes 41–46 define between them a series of compartments 51–56 which vary in volume through volumetric stages which are: (a) maximum, (b) convergent, (c) minimum, and (d) divergent. As illustrated, the compartments 51, 56 are in the maximum stage, the compartments 53, 54 are in the minimum stage and the compartments 52, 55 are respectively convergent and divergent. The compression chamber, defined by the wall 26, has a compression inlet port 57 which is adjacent to, and communicates with, the maximum stage 56 and a port 58 which is adjacent to, and communicates with, the convergent stage 52. In the preferred construction, the ports 57, 58 lie at the opposite extremes of the maximum and convergent stages.

Referring to FIG. 3, which shows the expansion section 22, the rotor 32 is similarly constructed having vanes 61–66 outwardly pressed by springs 67. The rotor is similarly eccentric for rotation about the axis 30 to define compartments 71–76 which vary in volume through the same volumetric stages, the maximum stage being indicated at 71, 76, the minimum stage at 73, 74, and the convergent and divergent stages at 70, 75, respectively. The expansion chamber is provided with an inlet port 77 and an outlet port 78 adjacent to the divergent and maximum stages and lying at the opposite extremes.

In accordance with one of the aspects of the present invention, grooves 59 (FIGS. 2, 2*a*) are arcuately formed in the wall 26 from the minimum stage to the inlet port 57 to extend the effective arcuate span of the inlet port from the minimum stage to the maximum stage and to prevent drawing a vacuum in the compartment indicated at 54. Similarly, grooves 79 (FIG. 3) are arcuately formed in the wall 27 from the minimum stage to the outlet port 78 to extend the effective arcuate span of the outlet port from the maximum stage and to prevent useless compression of air in the compartment 73. In short, the compressor inlet port and the expander outlet port are both extended over almost half a revolution.

It will also be noted in FIGS. 2 and 3 that the vanes 41–46 and 61–66, rather than being radial, are angled in a position cupped against the force of pressure. This serves primarily to strengthen the rotor by maintaining, for the sectors between the grooves, a substantial root dimension to reduce the tendency of a section to bend bodily about a root in the face of the applied pressure.

Interposed between the outlet port 58 of the compressor section and the inlet port 77 of the expander section is a heat exchanger 80 having an inlet 81 and an outlet 82.

With the rotors rotating in the direction indicated by the arrows, a charge of warm air is drawn through the opening 57 into the compartment 56, is progressively compressed in the divergent stage 52, with the compression being accompanied by an increase in the temperature of the air. The compressed air is then discharged through the port 58 into the heat exchanger 80 which is finned for efficient heat removal and which may, if desired, have an associated ventilating fan. As a result of the heat exchange, the compressed air which exits from the outlet 82 of the heat exchanger and which passes into the inlet port 77 of the expander section is substantially at ambient temperature. As the expander rotor 32 revolves, the air from the heat exchanger, being expanded in the divergent stage 75, drops in both pressure and temperature and is discharged in the cold state from the expander outlet port 78. From the outlet port, the air may be conducted by any suitable conduit 85 to the space which is to be cooled.

It is desirable that the air which is conducted through the heat exchanger 80 be at substantially constant pressure. To accomplish this, the compressor outlet port and expander inlet port are relatively so positioned that a smaller volume of air is defined at cut-off between adjacent vanes at the expander inlet port than at the compressor outlet port. More specifically, provision is made for equal masses of air to be contained between adjacent vanes at the expander inlet port and compressor outlet port. In the preferred embodiment, this is accomplished by making the ports 58, 77 (FIGS. 2 and 3) substantially symmetrical and by making the expander section of the device of shorter axial dimension than the compression section. Thus, while the convergent and divergent stages 52, 75, which are shown at the condition of cut-off, have the same axially projecting areas, indicated at A and B, the fact that the expansion section is axially shorter than the compression section means that, at cut-off, each expansion compartment is proportionately smaller than each compression compartment. By "cut-off" is meant the point at which each compression chamber is cracked open and the point at which each expansion chamber is finally closed. The difference in volume is directly in proportion to the absolute temperature of the air in the compartment, in accordance with Charles' law. Stated in other words, the dimensions of the two compartments, at cut-off, are so tailored that the masses of air contained between adjacent vanes at positions A and B are substantially equal so that equal quantities of air, per compartment are fed to and removed from the heat exchanger, the result being that compressed air is conducted through the heat exchanger at substantially constant pressure without net gain or loss and without surging. This desirable condition is, for convenience, termed "compensation".

However, in accordance with the invention, it is not essential for the two chambers to have different axial dimensions. The two portions of the device may have equal axial dimensions but the expander may be scaled down in radial size to a degree necessary to provide "compensation". As an alternative, the desired effect may be brought about by shifting the axis 30 of the rotor shaft laterally an incremental distance S with respect to the housing. This, as shown in FIGS. 4 and 5, has the effect of causing the axially projected area A to exceed the axially projected area B by the desired amount to achieve the equal mass condition. Or, if desired, the respective cut-off edges of the compressor outlet port and the expander inlet port, indicated at 58*a*, 77*a*, may both be shifted slightly in the direction opposite to the direction of rotor rotation, as illustrated in FIGS. 6 and 7, thereby causing the area A to exceed the area B for the equal mass condition. The compressor and expander rotors may, for simultaneous cut-off, be relatively shifted in like amount. In short, any geometric adjustment may be made, including a combination of the above, so that the mass of air at B is equal to the mass at A.

Having discussed the equal mass condition, there is a further desirable factor to be kept in mind: the leading edge 78*a* of the expander outlet port 78 should be so located that when the vane defining the expanding mass B reaches such leading edge, the mass is at substantially ambient pressure so that there is no sudden outward or inward puffing of air with its resultant noise. To reduce this likelihood under changing ambient temperature conditions, accompanied by changing temperature in the heat exchanger, a relief passage in the form of a narrow groove 78*b* may be formed in the wall of the chamber to provide equalization of pressure as the vane approaches the point of main release (see FIG. 3).

The invention has been described above in relation to four indentifiable stages in the rotative cycle. It is possible to describe the invention in even more simple terms when it is considered that the offset rotor within each of the chambers divides such chamber into two sides which, in the present instance, lie to the left and right of a vertical plane which contains both the chamber axis 28 and rotor axis 30. When so considered, the compression chamber has an arcuate inlet port 57 which, by reason of the grooves 59 (FIG. 2, 2*a*) extends over essentially the entire divergent side of the compressor compartment together with a concentrated outlet port 58 which is located near the end of the opposite or convergent side, so that air taken in at the inlet port in successive compartments is discharged in the compressed state to the heat exchanger. Similarly, the expansion chamber has a concentrated inlet port 77 which is located near the beginning of the divergent side for receiving compressed air from the heat exchanger. Finally, the expansion chamber has an arcuate outlet port 85, which by reason of the associated grooves 79, effectively extends over the entire convergent side for discharging the expanded air at low temperature. As stated, the large arcuate extent of the inlet port 57 insures against drawing a vacuum in the compartments on the expansion side of the compression chamber, and the large arcuate extent of the outlet port 85, as extended by groove 79, insures against any unwanted compression of air as the compartments traverse the compression side of the expansion chamber.

By way of summary, equal masses of air are caused to enter and leave the heat exchanger at a given time interval by locating the concentrated ports relative to the rotor geometry. This is done by port modification as taught in FIGS. 6 and 7, by reducing the axial length of the rotor as taught in FIGS. 1–3, or by incrementally offsetting the rotor shaft in a lateral direction as taught in FIGS. 4 and 5. It will be understood that the term "rotor geometry" includes not only these possibilities but, in addition, the use of rotors in compartments of different radius, the use of vanes of different thickness, and any other desired means for achieving differential volumes in the compartments in the two sections of the machine. Indeed, it will be understood that the term "rotor geometry" shall be interpreted broadly enough to include operation of the expander rotor at a slightly slower speed so that equal masses of air enter and leave the heat exchanger in a given time interval.

The advantages of the dual construction will be apparent. In the first place it permits use of chambers 26, 27 having perfectly cylindrical walls easily generated by conventional boring and grinding equipment. Secondly, the fact that the vanes rotate in a perfectly circular path avoids the setting up of "coriolis" accelerational forces so that the unit need not be constructed with the high precision required where radial acceleration of the vanes in opposite directions must be dealt with. The lack of coriolis acceleration of the vanes may be readily appreciated by picturing the vanes rotating in their ordinary paths but with the rotor absent. It will then be seen that, with respect to a fixed point, the vanes bodily rotate with no reciprocating movement with respect to the point of observation.

SIMPLIFIED CONSTRUCTION

It is one of the features of the present dual rotor construction, with separate compression and expansion chambers, that hinged or bendable vanes may be employed in lieu of the sliding vanes, and their attendant friction, of the earlier embodiment.

Thus, referring to FIGS. 8–14 a construction is shown which is susceptible to manufacture at minimum cost and, if desired, to extreme miniaturization. To facilitate understanding, the same reference numerals are employed as in the case of the previous embodiment, but in each instance greater by 100. Thus a compressor-expander assembly 120 is provided having compression and expansion sections 121, 122 with end plates 123, 124 and a separator plate 125 all secured together by longitudinally extending bolts 126 to form a compact stacked assembly. The rotors 131, 132, jointly mounted upon shaft 130 are provided with sets of vanes 141–146 and 161–166, respectively.

As shown in FIG. 11 the compressor inlet port 157 is effectively extended by grooves 159 so as to span almost the entire divergent (right-hand) side of the compressor. Similarly the expander outlet port 178 (FIG. 12) is effectively extended by grooves 179 so that it spans substantially the entire convergent side. This insures that the main ports will "fill" and "empty" to the maximum extent and that no unnecessary work will be done on air held captive in the compartments over the non-working portion of the cycle.

It is one of the features of the present invention that the vanes, instead of being slidable in slots in the rotor are integrally formed in thin tapering cross section, with the tips thereof lightly and resiliently bearing against the cylindrical chamber walls 126, 127. It is also one of the features of the invention that the vanes are secured to the rotor cantilever-fashion and extending in opposite directions so as to contain the pressure in each portion of the device by cupping action. Thus referring to FIG. 11, the vane 142 which is shown in the active compressing condition is cupped, that is, concave, in the direction of the pressurized air A. The result is that the outer edge of the vane, indicated at 142*a*, is urged by the pressure sealingly against the wall 126 of the chamber. Similarly, in the expansion section illustrated in FIG. 12, the vane 166 which is subjected to the pressurized air B is cupped, or concave, toward the pressure side so that the effect of the pressure is to urge the edge 166*a* into more intimate contact with the cylindrical wall 127. It is found that by such cupping action, "blow-by", that is, leakage of air around the vane, is prevented, so that even though the vane is thin and flexible it is well able to withstand high pressure. In a practical case a vane having an average thickness of only 0.050 inch and measuring approximately 1.5 inches by 1.5 inches is capable of withstanding an unbalanced pressure on the order of 35 pounds per square inch. It is to be particularly noted that this condition is only achieved where the vanes on the compression and expansion rotors are faced oppositely to one another with both being cupped, or concave, in the direction of the pressure. Thus this is a feature which is unique to the dual rotor and which cannot be achieved in the type of construction disclosed in my prior patent mentioned above.

The degree of taper of the vane thickness is preferably such that each vane bends uniformly inwardly and outwardly, thereby avoiding any region of concentration of bending stress, especially at the base.

For the purpose of providing compensation for handling of equal masses the expansion section 122 is preferably shorter, in axial length, just as in the structure of FIG. 1, so that even though the projected areas A, B are the same, the volumes satisfy the equal mass condition. Alternatively, the shaft 130 may be laterally shifted through an incremental distance as in FIGS. 4 and 5, or the edges of the heat exchanger ports 158, 177 may be shifted in the direction contrary to the direction of rotor rotation as in FIGS. 6 and 7.

To provide a small amount of prestress, the rotor vanes 141–146 are, in the unflexed state, either straight or have a small amount of reverse curvature as illustrated in FIG. 13. The rotor 131 in that figure may, conveniently, be molded of flexible plastic such as polyethylene or Delrin, the material preferably being "loaded" with a lubricating agent such as molybdenum disulfide when in the molten state. In addition the inner surfaces of the chamber in which the rotor rotates may be coated with Teflon. As a further alternative, the rotor 131 may itself be molded of Teflon.

However, it is preferred, in lieu of molding, to form the vanes 141–146 by a "skiving" operation from a perfectly annular blank 200 of flexible plastic as set forth in FIG. 14. In this figure the parting lines of the vanes to be formed are indicated by the dot-dash profiles. The skiving may be accomplished by a knife 201 mounted upon a carriage 202 supported upon rollers 203 rolling on a track 204. A total of four rollers may be used having a span which exceeds the axial dimension of the rotor blank 200 so that the knife 201 may take on unobstructed cut. Means (not shown) are provided for clamping the blank 200 in the illustrated position, whereupon the carriage 202 may be forced along the track, with the profile of the track determining the profile of the cut taken by the blade, until the carriage finally abuts a stop 205 at the end of the track.

It will be apparent to one skilled in the art that any clamp capable of immobilizing the blank 200 for cutting may include provision for indexing in 60° increments, so that a series of vanes may be skived in quick succession on a production basis.

After the skiving operation is complete, each of the vanes is preferably heated so that it acquires a permanent set in the outwardly extending, reversely-curled direction illustrated in FIG. 13. This is accomplished by a heating jig 210 illustrated in FIG. 15 having a pair of dies 211, 212 heated by electrical heating elements 213, 214, respectively so that the material is raised to a temperature of incipient flow, or at least up to a stress-relieving level. The heated dies 211, 212 may be mounted on levers 215, 216 pinned together at 217 and with bias provided by a spring 218. To release the device from the blade after the vane has acquired a "set" shape and position, the handles are simply pressed together to compress the spring. It will be apparent to one skilled in the art that the device is susceptible to improvement for high production and that a jig may be provided having six sets of heated dies which are simultaneously clamped in heating position and simultaneously released.

One advantage of a rotor formed as in FIGS. 14 and 15, especially where made by a skiving operation, is that each vane has a perfectly receptive and matching recess in the rotor so that there is substantially no residual or carry-over volume as the minimum stage of the cycle is traversed.

While I prefer to form the blades of thin bendable plastic integrally hinged to the periphery of the rotor, the present invention is not limited thereto, and it is proposed that the vanes on the two rotors be freely hinged to the rotor peripheries, for example, by capturing a circular bead formed on the inner edge of each vane in an undercut, "keyhole" slot which is either machined or molded in the rotor blank. This is illustrated in FIGS. 16 and 17 which correspond to FIGS. 11 and 12, except for the manner in which the vanes are mounted, and with corresponding reference numerals, further increased by 100, being employed to designate similar parts. The vanes in the embodiment illustrated in FIGS. 16 and 17 are preferably formed of bendable plastic loaded with anti-friction material just as in the case of the vanes in the preceding embodiment, and the inner walls of the chambers may be similarly coated, for example, with Teflon.

Where the beads 290 of the vanes are freely, but captively, pivoted in the grooves 291, centrifugal force, as the device starts up, will usually suffice to insure initial seating against the walls 226, 227 of the chamber, with subsequent development of pressure, against the concavely cupped side serving to effect a seal against "blow-by" of air. Nevertheless, if desired, small coil springs 292 fitted into recesses 293 under each of the vanes may be used to provide a light outward bias.

The structure illustrated in FIGS. 8–17, with either integral flexible vanes or hinged vanes, lends itself well to extreme miniaturization to provide "spot" cooling wherever refrigeration may be desired as, for example, in the cooling of electronic and electrical components. There is substantially no limit to the degree of miniaturization, and the device shown in FIG. 8 may be reduced, if desired, to two inches or so in major dimensions. A typical miniaturization refrigeration "package" is illustrated in FIG. 18 where a compressor-expander unit 120 of "squarish" cross section, is close-coupled to a drive motor 300 at one end and which has an end face 301 at the other. A heat exchanger 302 at the end face is connected to the readily accessible compressor outlet port 158 which is in the lower left-hand corner of the end profile as illustrated in FIG. 19. A second heat exchanger connection is made at the end face, communicating with expander inlet port 177 through a conduit 303 which penetrates the stack in the lower right-hand position. The heat exchanger 302 is in the form of a finned tube bent into circular configuration as illustrated in FIG. 19 and has, centered within it, a blower rotor 304 which is mounted on the remote end of the shaft 129. Ambient air is conducted to the center of the blower through an opening 305. Outward venting occurs through openings 306. The expander outlet port 178 is coupled to a suitable conduit 307 for conducting the cold air to the point where it is required.

It is one of the features of the present "dual" construction that the portions of the device, compressor and expander, arranged side by side, may be insulated from one another to prevent leakage of heat from the compressor to the expander structure and to enable the two parts of the device to work efficiently at different operating temperatures. This may be done simply in the structure shown in FIG. 8 by addition of an insulating layer in the separator plate 125. In such event the separator plate would consist of three layers,, a pair of closure plates for the respective sections and an intervening layer 310 of insulation (FIG. 20). The insulating layer may, for example, be formed of a solid plastic ring or "spacer" 311 which follows the periphery and which defines a space which is filled by a layer of insulating foam 312. It will be apparent that a similar insulating layer may occupy the space indicated at 313 in FIG. 1. It is not necessary, in the present construction, to resort to special means to inhibit transmission of heat endwise in the shaft 130 because of the insulating effect of the plastic rotor bodies. In larger compressor-expander assemblies using metallic rotors as illustrated in FIGS. 1–3 it will be apparent that the shaft 30 may be made of composite construction, including an insulating barrier, to reduce direct endwise transmission of heat through the shaft.

The refrigeration unit illustrated in FIG. 18 may also include an insulating layer 314 between the expander section 122 and the motor 300 to prevent loss of cooling effect to the motor frame. However, the thickness of the layer 304 may be intentionally limited, or the layer may be omitted, to enable the motor to receive some cooling from the expansion section, permitting use of a non-ventilated version of motor.

It has been assumed in the above discussion that the housing is of thermally conductive metal. In a low cost version the housing, including both the compressor and expander portions may be molded of plastic of low thermal conductivity, preferably of a type having self-lubricating properties or loaded with lubricant as set forth in FIG. 21. In the latter figure the housing includes a unitary cylindrical member 310 having end members 321, 322. The end members journal a shaft 330 having rotors 331, 332 spaced end to end thereon, the rotors being of the type previously described in connection with FIG. 13. The cylinder 320 is separated to define compression and expansion chambers 333, 334 by a disc 340 telescoped into the cylindrical member and which may be sealed by an "O" ring 341. The disc has a bore for accommodating the shaft and which may be lined by an anti-friction bushing 342. The disc, which is preferably formed of wear resistant plastic, is thermally insulating and it may be foam filled, if desired, to increase its insulating properties.

While it is preferred to mount the compression and expansion portions of the device coaxially, with rotors upon the same shaft, it will be understood that the invention, in its broader aspects, is not limited to this and the two sections of the device may, if desired, be mounted edge to edge with their rotors on separate shafts laterally spaced from one another and with any means such as a cog belt (not shown) or pair of gears for interconnecting the two shafts. Consequently, the term "side by side" used in the claims shall be deemed to include either coaxial mounting or mounting of the compressor and expander sections edge to edge. In edge to edge mounting "compensation" may be effected by making the volumes A and B equal, by rotating the expander at a lower speed, a speed which is inversely proportional to the masses of air in such volumes. Such differential speed may be readily obtained by using pulleys of unlike size for the drive belts or by using gears proportioned to provide the desired step down ratio. Alternatively, the volume of B may be reduced by laterally shifting the drive shafts as set forth in FIGS. 4 and 5.

In the various embodiments described above the ports are formed by radial openings in the wall of the housing. By forming the ports as a plurality of peripherally-extending slots (see 57, 58 and 77, 78 FIGS. 1–3) and grooves (FIG. 2*a*), continuous land surfaces are always presented to support the vane tips in their circular path of movement. Moreover, the vane tips are fully supported without reliance on narrow land surfaces whenever the vanes are under pressure. As a result traversal of the parts by the vanes does not result in accelerated wear at the vane tips. However if it is desired to protect the tips to maximum degree, it is not necessary to use radial porting and ports may instead be formed axially in the end plates as shown in FIG. 22, where reference numerals are used corresponding to FIGS. 10 and 12 with addition of subscript *a*. In this figure the expander inlet port is in the form of a through-opening 177*a* formed in the end plate 124*a*, while the expander outlet port is in the form of an arcuately extensive through-opening 178*a*. Conduits may be provided registering with such openings and similar axial openings may be formed in the companion end plate 120 (FIG. 9) for servicing of the compression stage (FIG. 11).

Or, if desired, cooperating passages may be formed in both the cylindrical walls of the chamber and in the end walls. For example the main expander outlet port 178 may be formed in the cylindrical wall as shown in FIG. 12 while connecting arcuate grooves, functionally similar to the grooves 179, may be formed in the inside surface of the end plate 124. Thus as used herein the term "inner wall" includes both the cylindrical wall of the housing and the presented walls of the end plates. The term "hinged" as used herein includes both pivoted and flexible articulated joints. The term "plastic" refers to any flexible wear-resistant, non-metallic material of construction.

I claim as my invention:

1. In a refrigeration system, a compressor-expander assembly comprising a housing defining compression and expansion chambers arranged side by side, compressor and expander rotors of cylindrical shape journaled for rotation in the respective chambers and having a common drive connection for rotating the same, vanes equally spaced about the rotor peripheries and having their outer edges extending into effective engagement with the walls of the respective chambers to define compartments between the adjacent vanes, the rotor axis being offset from the chamber axis so that the surface of each rotor extends closely adjacent to the wall of the chamber so that each chamber has a convergent side and a divergent side, the compression chamber having an arcuate inlet port which extends over substantially the entire divergent side and a concentrated compressor outlet port which is located near the end of the convergent side so that air taken in at the inlet port in successive compartments is discharged in the compressed state with an increase in temperature, a heat exchanger for receiving the compressed air and for restoring its temperature to near the ambient level, the expansion chamber having a concentrated inlet port located near the beginning of the divergent side and connected to receive compressed air from the heat exchanger, the expansion chamber having an arcuate expander outlet port which extends over substantially the entire convergent side for discharge of the cold expanded air at ambient pressure, and conduit means for conducting the cold air to the space to be cooled, the concentrated ports being so located relative to the geometry of the rotors that equal masses of air enter and leave the heat exchanger in a given time interval so that the heat exchanger operates at a substantially constant pressure.

2. The combination as claimed in claim 1 in which the compressor inlet and expander outlet ports are formed by lateral openings in the housing together with associated arcuate grooves in the walls of the respective chambers in communication with the openings for extending the effective length of the ports.

3. The combination as claimed in claim 1 in which the vanes associated with each of the rotors are of arcuate profile hingedly secured to the associated rotor and cupped in a direction to contain the pressure.

4. The combination as claimed in claim 3 in which the rotors are mounted coaxially upon the same shaft with the vanes thereon being cupped in opposite directions.

5. The combination as claimed in claim 1 in which the rotors are formed of durable, flexible plastic material and in which the vanes are integral therewith.

6. The combination as claimed in claim 5 in which the vanes are formed of material partially severed from the rotor surface to form a cantilever connection.

7. The combination as claimed in claim 5 in which the vanes are integral with the rotor and are of tapering thickness so that during the convergent and divergent stages the vanes flex more or less uniformly throughout their length to change the volume of the compartments defined thereby.

8. The combination as claimed in claim 5 in which the vanes are integral with the rotor and are of tapering thickness so that during the convergent and divergent stages the vanes flex more or less uniformly throughout their length to change the volume of the compartments defined thereby, the rotor having a matching recess adjacent each vane for receiving the vane and restoring the presented surface of the rotor to cylindrical shape to minimize carryover of air between the convergent and divergent sides.

9. The combination as claimed in claim 5 in which the vanes in the natural unstressed state extend radially outwardly with the edges thereof defining a diameter which exceeds the diameter of the chamber so that when the rotor is inserted into the chamber the vanes resiliently bear against the inner wall of the chamber providing a light static seal with respect thereto for initial confinement of air and with build-up of pressure serving thereafter to force the vanes against the cylindrical wall of the chamber to provide a seal, the vanes being made of a plastic material and having self-lubricating properties at the region of engagement with automatic take-up of wear.

10. The combination as claimed in claim 1 in which the inner wall of the chamber is coated with a layer of anti-friction material.

11. The combination as claimed in claim 9 in which each vane in the natural state has a slight curvature opposite to the cupped curvature assumed by the vane when the rotor is inserted into the chamber so as to provide light pre-stress between the edge of the vane and the wall of the chamber.

12. The combination as claimed in claim 3 in which the rotors are formed with a series of undercut longitudinal slots and in which each vane has a circular bead along its inner edge for free registered reception in a slot to provide limited hinging movement of each vane with respect to the rotor between an outwardly extended position and a position in which the vane is nested against the surface of the rotor.

13. The combination as claimed in claim 1 in which each rotor has vane slots which are symmetrically angled with respect to the radial direction and in which the vanes are respectively slidable.

14. The combination as claimed in claim 1 in which the cut-off point of at least one of the ports to which the heat exchanger is connected is shifted from a condition of symmetry slightly in a direction opposite to the direction of the rotor rotation so that a smaller volume of air is defined at cut-off between adjacent vanes at the expander inlet port than at the compressor output port thereby to tend to equalize the masses of air defined between adjacent vanes at the compressor outlet port and expander inlet port so that air flows throught the heat exchanger in the compressed state from one of the ports to the other at substantially constant pressure.

15. The combination as claimed in claim 1 in which the rotors are coaxial and in which the rotor shaft is shifted laterally by an incremental amount with respect to the housing so that a smaller volume of air is defined at cut-off between adjacent vanes at the expander inlet port than at the compressor outlet port thereby to tend to equalize the masses of air defined between adjacent vanes at the compressor outlet port and expander inlet port so that air flows through the heat exchanger in the compressed state from one of the ports to the other at substantially constant pressure.

16. The combination as claimed in claim 1 in which the chambers are coaxial and in which the expansion chamber has a shorter axial dimension than the compression chamber thereby to tend to equalize the masses of air defined between adjacent vanes at the compressor outlet port and expander inlet port so that air flows through the heat exchanger in the compressed state from one of the ports to the other at substantially constant pressure.

17. The combination as claimed in claim 1 in which the housing is in two axially spaced portions and in which a layer of insulation is provided between the portion of the housing which defines the expansion chamber and the portion which defines the compression chamber to inhibit transfer of heat between the two chambers and to permit the chambers to operate at substantially different temperatures.

18. The combination as claimed in claim 1 in which the housing consists of two portions intimately stacked together in coaxial relationship with a separator plate interposed between them penetrated by the drive shaft, the housing being enclosed at the ends by respective bearing plates having bearings for journaling the end portions of the shaft.

19. The combination as claimed in claim 1 in which the housing consists of two portions, each enclosed by an end plate and a closure plate, the two portions being axially stacked together with a layer of insulation between the adjacent closure plates thereby to inhibit flow of heat from one portion to the other.

20. The combination as claimed in claim 1 in which the housing includes compressor and expander portions for defining the respective chambers, each portion having an end plate for journaling the drive shaft, and a separator between the portions for isolating the chambers from one another, the separator plate being made of thermally insulating material, and means for clamping all of the parts tightly together endwise as a unit.

21. The combination as claimed in claim 1 in which the housing is formed of a unitary cylindrical member having end plates, the drive shaft being journaled in the end plates and having the rotors spaced end to end thereon, and a separator plate interposed between the rotors for defining separate compression and expansion chambers, the separator plate being made of wear resistive material having insulative properties and in the form of a closely fitting disc telescoped into the cylindrical member.

22. In a refrigeration system, a compressor-expander assembly comprising a housing defining compression and expansion chambers arranged side by side, compressor and expander rotors of cylindrical shape journaled for rotation in the respective chambers and having a common drive connection for rotating the same, vanes symmetrically spaced about the rotor peripheries and having their outer edges extending into effective engagement with the walls of the respective chambers to define compartments between the adjacent vanes, the rotor axis being offset from the chamber axis so that the surface of each rotor extends closely adjacent to the wall of the chaamber so that each chamber has a convergent side and a divergent side, the compression chamber having an arcuate inlet port which extends over substantially the entire divergent side and a concentrated compressor outlet port which is located near the end of the convergent side so that air taken in at the inlet port in successive compartments is discharged in the compressed state with an increase in temperature, a heat exchanger for receiving the compressed air and for restoring its temperature to near the ambient level, the expansion chamber having a concentrated inlet port located near the beginning of the divergent side and connected to receive compressed air from the heat exchanger, the expansion chamber having an arcuate expander port which extends over substantially the entire convergent side for discharge of the cold expanded air at ambient pressure, a motor close coupled to one end of the drive shaft, the heat exchanger being in the form of a finned conduit at the remote end of the drive shaft, a fan on the remote end of the drive shaft for driving air through the fins of the heat exchanger, and means for conducting the cold air from the expander outlet port to the space to be cooled.

23. The combination as claimed in claim 22 in which the housing is of squarish cross section having an end face remote from the motor, the compressor outlet port terminating at the end face in a first corner position to provide a heat exchanger inlet connection, means providing a heat exchanger outlet connection in a second corner position formed by a conduit extending from the end face to the expander inlet port, the heat exchanger lying closely adjacent the end face.

24. The combination as claimed in claim 1 in which said compression and expansion chambers are in the form of circular cylinders.

* * * * *